US005745020A

United States Patent [19]

Shen-Long et al.

[11] Patent Number: 5,745,020

[45] Date of Patent: Apr. 28, 1998

[54] FLYBACK TRANSFORMER WITH A BUILT-IN PIN FOR GENERATING FLYBACK PULSE SIGNAL

[75] Inventors: Chiang Shen-Long; Kuan Meng-Tsan, both of Kweishan, Taiwan

[73] Assignee: Acer Peripherals Inc., Kweishan, Taiwan

[21] Appl. No.: 606,578

[22] Filed: Feb. 26, 1996

[51] Int. Cl.[6] ..... H01F 27/02

[52] U.S. Cl. ..... 336/92; 336/192; 336/198; 336/208

[58] Field of Search ..... 336/90, 92, 192, 336/198, 208

[56] References Cited

U.S. PATENT DOCUMENTS

| | | | |
|---|---|---|---|
| 3,939,450 | 2/1976 | Donnelly | 336/90 |
| 4,144,480 | 3/1979 | Nagasaki et al. | 315/411 |
| 4,200,853 | 4/1980 | de Jong et al. | 336/192 |
| 4,334,206 | 6/1982 | Nakamura | 336/198 |
| 4,363,014 | 12/1982 | Leach et al. | 336/90 |
| 5,160,872 | 11/1992 | Kenji et al. | 315/411 |
| 5,214,403 | 5/1993 | Bogaerts et al. | 336/90 |
| 5,287,479 | 2/1994 | Masaru et al. | 315/411 |
| 5,448,216 | 9/1995 | Kuze et al. | 336/90 |
| 5,559,486 | 9/1996 | Ikenoue et al. | 336/198 |

*Primary Examiner*—Jeffrey L. Sterrett

*Attorney, Agent, or Firm*—Fish & Richardson P.C.

[57] ABSTRACT

A flyback transformer for a display device circuitry is provided. The flyback transformer has a low voltage bobbin, a high voltage bobbin, a core and a casing, and the casing includes a slot. The flyback transformer is characterized in that the flyback transformer comprises a pin inserted within the slot of the casing with two ends of pin sticking out from two end openings respectively, and functions to generate a positive flyback pulse signal and a negative flyback pulse signal at two ends thereof respectively during a flyback operation of the circuitry. An insulating portion is provided between the pin and the core. Wherein, a side edge of the low voltage bobbin comprises a connection portion for insertion into the slot of the casing and functions as the insulating portion.

5 Claims, 3 Drawing Sheets

FLYBACK TRANSFORMER WITH A BUILT-IN PIN FOR GENERATING FLYBACK PULSE SIGNAL

FIELD OF INVENTION

The invention relates generally to a flyback transformer and, more particularly, to a flyback transformer with a built-in pin for generating flyback pulse signal.

BACKGROUND OF INVENTION

A flyback transformer is generally implemented within the circuits of a display device for providing distinctive voltages required by the circuit operation of the display device. Some U.S. Patents, i.e. U.S. Pat. Nos. 5,160,872, 5,287,479 and 4,144,480 may be referred in order to have an in-depth understandings of structures of flyback transformer and functions of High Voltage output, Focus output and Screen output of flyback transformer.

One conventional way of assembling the electrical wire, which generates a flyback pulse signal, with a flyback transformer is introduced hereinafter. The output lead of High Voltage is manually inserted within the corresponding slot of the high voltage bobbin before the insulation resin is injected, which isolates the high voltage from other components of the flyback transformer. The flyback transformer is eventually completed after the Focus output lead and the Screen output lead are manually inserted therein. Afterwards, an electrical wire is provided and inserted through the space defined by shape of the core in order to generate a positive flyback pulse signal (sync+) and a negative flyback pulse signal (sync−) respectively at ends of the electrical wire during the flyback operation of the flyback transformer. A extra connector must be provided to accommodate both ends of the electrical wire such that the positive flyback pulse signal (sync+) and a negative flyback pulse signal (sync−) may be input to the printed circuit board and utilized by an automatic frequency control circuit. It is well known in the arts that the automatic frequency control circuit uses the positive flyback pulse signal (sync+) or a negative flyback pulse signal (sync−), that choice depending on the type of transistors implemented therewithin, to adjust the horizontal oscillation frequency automatically so as to minimize the influence of noise. Therefore, either end of positive flyback pulse signal (sync+) or negative flyback pulse signal (sync−) must be marked to avoid incorrect polarization when inserted within the corresponding socket on the printed circuit board. Furthermore, the conventional approach requires a bundle to limit the freedom of the electric wire.

This article of flyback transformer with electric wire therewith is afterwards transported to an assembly area of the printed circuit board by, in typical, a conveyer system. The operator of this assembly area then assembles the flyback transformer at predetermined location of the printed circuit board. Afterwards, the printed circuit board with the flyback transformer and the electric wire thereon is transported to an assembly area of the display device by, in typical, a conveyer system. From above recitations, it is obvious, manual insertion of the electric wire, marking of either end of positive flyback pulse signal (sync+) or negative flyback pulse signal (sync−) and the following insertion into the corresponding socket on the printed circuit board may also introduce human errors. Any errors introduced can be corrected only by another extra manual operation which results in a loss of production efficiency.

To overcome the above mentioned drawbacks, the instant invention provides a flyback transformer with a built-in pin for generating a flyback pulse signal. The built-in pin functions as the conventional electrical wire aforesaid.

SUMMARY OF THE INVENTION

A flyback transformer for a display device circuitry which has a low voltage bobbin, a high voltage bobbin, a core, a pin and a casing. The casing includes a slot.

The pin is inserted within the slot of the casing with two ends of pin sticking out from two end openings of the slot respectively, and functions to generate a positive flyback pulse signal and a negative flyback pulse signal at two ends thereof respectively during a flyback operation of the circuitry.

An insulating portion is provided between the pin and the core. In one preferred embodiment, a side edge of the low voltage bobbin comprises a connection portion for insertion into the slot of the casing and functions as the insulating portion.

DETAILED DESCRIPTION OF THE EMBODIMENT

Figure 1:
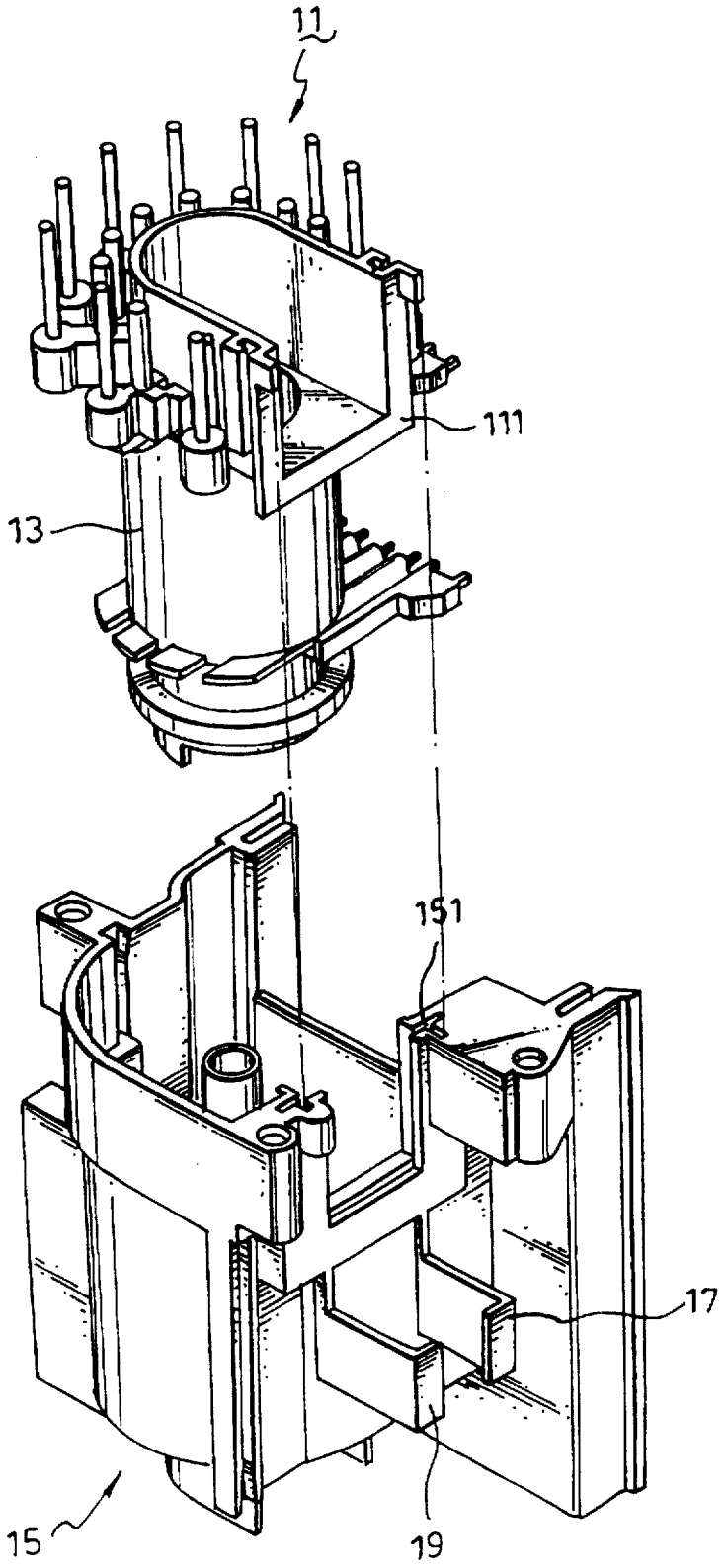
FIG. 1 illustrates an explosive view of the high voltage bobbin, low voltage bobbin and casing of the flyback transformer in accordance with the present invention.

As shown in FIG. 1, the flyback transformer of the instant invention has a low voltage bobbin 11, a high voltage bobbin 13 and a casing 15. Same as the conventional flyback transformer, the low voltage bobbin 11 includes a plunger (not shown) inserted into a corresponding slot(not shown) of the high voltage bobbin 13 to exhibit an assembly form shown in FIG. 1. The side edge of the low voltage bobbin 11 of the invention includes a connection portion 111 for insertion into a corresponding slot 151 of the casing 15 of the flyback transformer, the detail of which will be more clear hereinafter.

Figure 2:
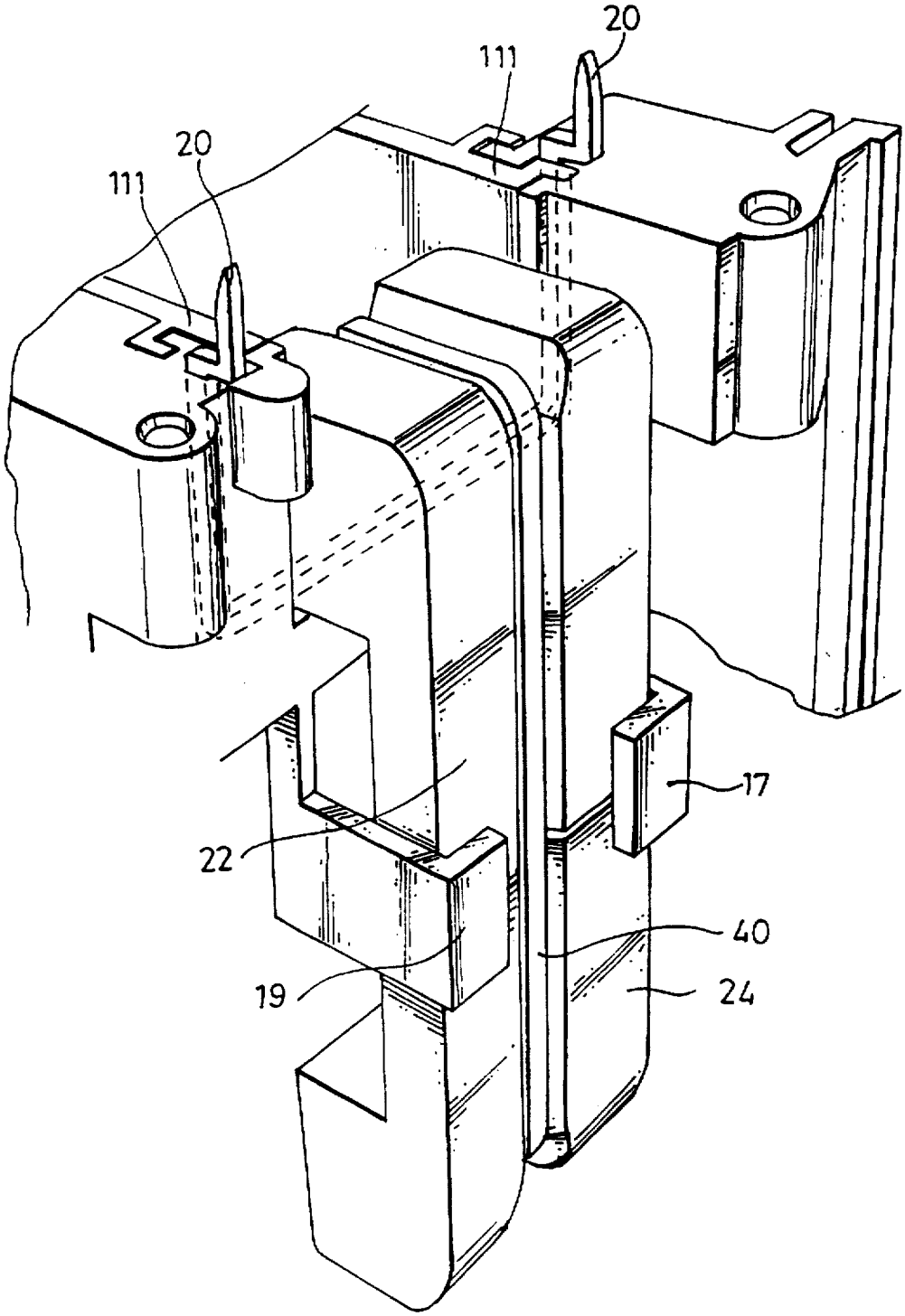
FIG. 2 illustrates the relation between the built-in pin, the casing, the low voltage bobbin and core of the flyback transformer when assembled.
Figure 3:
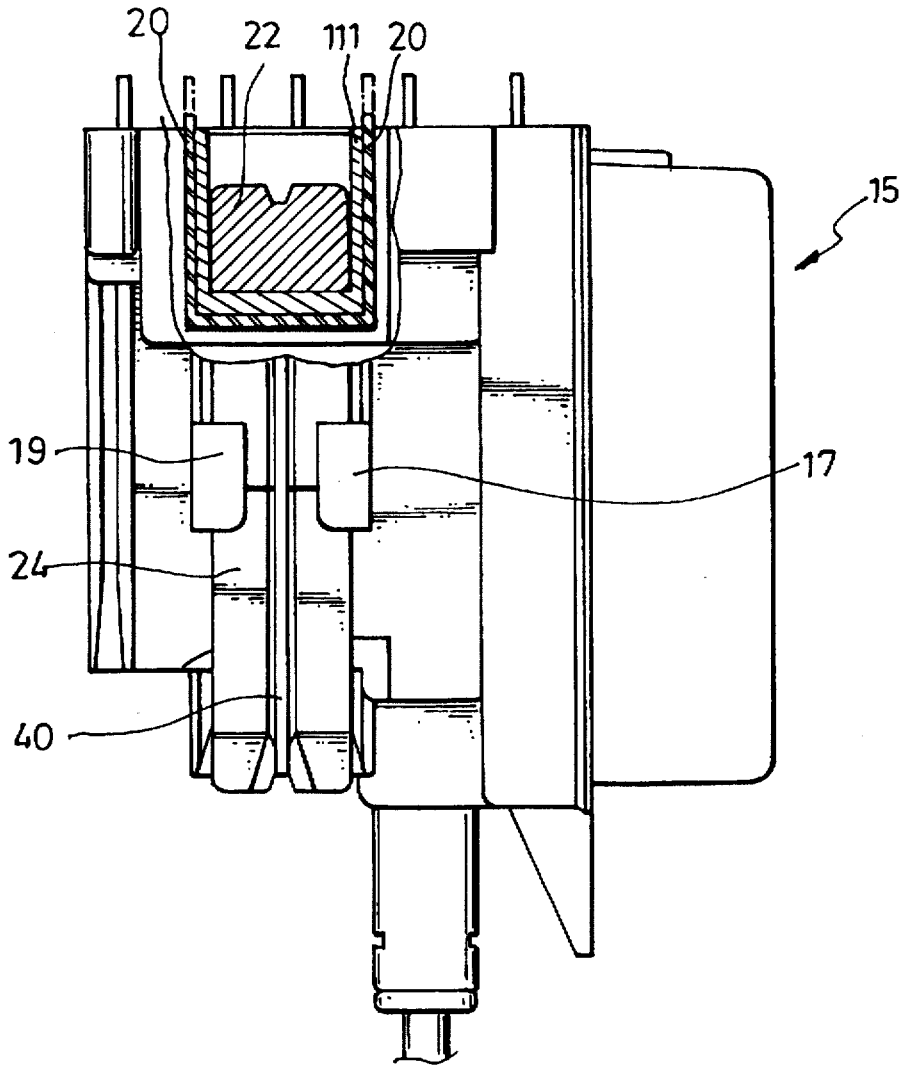
FIG. 3 illustrates the relation between the built-in pin, the casing, the low voltage bobbin and core of the flyback transformer, when assembled, in partial cross section view.

As shown in FIG. 2 and FIG. 3, a pin 20, which has a span wider than that of the connection portion 111, is provided in the invention. This pin 20 is inserted within the slot 151 with two ends of pin 20 sticking out from two end openings of the slot 151 respectively, and functions to generate a positive flyback pulse signal (sync+) and a negative flyback pulse signal (sync−) at the ends thereof respectively. As shown by the dot line of pin 20 in FIG. 2, the pin 20 passes through the space defined by the shape of the upper core 22. The assembly steps of the flyback transformer of the invention includes: (1) inserting the pin 20 into the slot 151; (2) with the connection portion 111 inserted into the slot 151, placing the assembly form of the low voltage bobbin 11 and high voltage bobbin 13 into the inner space defined by the casing 15; (3) placing the upper core 22 and lower core 24 within the space defined by the position device 17, 19 such that the pin 20 spans under and across the upper core 22 as shown in FIG. 2.

As shown in FIG. 3, after assembled together, the pin 20 are separate from the upper core 22 by the connection portion 111 which generally is made of plastic of engineering class. Furthermore, the upper and lower core 22, 24 have slot 40 for accommodating an elastic retainer to retain the upper and lower core 22, 24 from unexpected movement.

The pin 20 obviously functions to generate a positive flyback pulse signal (sync+) and a negative flyback pulse signal (sync−) at the ends thereof respectively. The sticking-out ends of the pin 20 may be directly inserted into the predetermined corresponding holes of the printed circuit board with other pins during the assembly procedure of the flyback transformer to the printed circuit board. The printed circuit board(not shown) may includes a foolproof design such that the pin 20 is always inserted in a correct polarization. The invention overcomes the drawbacks of the conventional approach.

We claim:

1. A flyback transformer for a display device circuitry, the flyback transformer having a low voltage bobbin, a high voltage bobbin, a core and a casing, the casing including a slot which has two end openings, characterizing in:

the flyback transformer comprising a pin inserted within the slot of the casing with two ends of pin sticking out from said two end openings respectively, the pin functioning to generate a positive flyback pulse signal and a negative flyback pulse signal at said two ends respectively during a flyback operation of the circuitry, an insulating portion being provided between the pin and the core.

2. The flyback transformer as recited in claim 1, wherein a side edge of the low voltage bobbin comprises a connection portion for insertion into the slot of the casing and functions as the insulating portion.

3. A method for assembling a flyback transformer for a display device circuitry, the flyback transformer having a low voltage bobbin, a high voltage bobbin, an upper core, a lower core, and a casing, the casing including a slot which has two end openings, a side edge of the low voltage bobbin including a connection portion for insertion into the slot of the casing, comprising the steps of:

(1) inserting a pin into the slot with two ends of pin sticking out from said two end openings respectively, the pin functioning to generate a positive flyback pulse signal and a negative flyback pulse signal at said two ends respectively during a flyback operation of the circuitry;

(2) placing an assembly form of the low voltage bobbin and high voltage bobbin into an inner space defined by the casing, with the connection portion inserted into the slot for isolating the pin from the upper and lower core;

(3) placing the upper core and lower core within a space defined by a positioning means such that the pin spans under and across the upper core.

4. A flyback transformer for display device circuitry, the flyback transformer comprising:

a casing having an inner space, a position device, and a slot with two end openings;

a low voltage bobbin disposed within the inner space of the casing, the low voltage bobbin including a side edge having a connection portion inserted within the slot of the casing;

a high voltage bobbin disposed within the inner space casing;

upper and lower cores, each core supported by the position device of the casing; and a pin inserted into the slot, the pin having two ends extending from respective ones of said two end openings of the slot, the pin adapted to generate a positive flyback pulse signal and a negative flyback pulse signal at said two ends respectively during a flyback operation of the circuitry.

5. The flyback transformer of claim 4 wherein the pin extends under and across the upper core.

* * * * *